United States Patent [19]

Shank

[11] 4,191,363

[45] Mar. 4, 1980

[54] QUENCHING DEVICE FOR INDUCTIVELY HEATED WORKPIECES

[75] Inventor: Robert J. Shank, Garfield Heights, Ohio

[73] Assignee: Park-Ohio Industries, Inc., Cleveland, Ohio

[21] Appl. No.: 935,949

[22] Filed: Aug. 23, 1978

[51] Int. Cl.[2] ..... C21D 1/66

[52] U.S. Cl. ..... 266/129

[58] Field of Search ..... 266/129; 148/143, 150

[56] References Cited

U.S. PATENT DOCUMENTS 3,675,908 7/1972 Amend ..... 148/143

*Primary Examiner*—R. Dean

*Attorney, Agent, or Firm*—Meyer, Tilberry & Body

[57] ABSTRACT

A device for directing quench fluid onto the top of an inductively heated surface portion of a rotating workpiece has a supply means having an outlet end spaced horizontally from said surface portion for directing a jet of quench fluid therefrom and a deflector for intercepting and guiding the quench fluid jet onto the top of the heated surface portion of the workpiece. The spacing of the outlet end horizontally from the heated workpiece surface portion prevents the falling thereonto and contacting therewith of any drippage of residual quench fluid from the outlet end following shut-off of the supply of quench fluid thereto and during subsequent inductive reheating of the quench hardened surface portion to temper it.

12 Claims, 5 Drawing Figures

FIG. 1
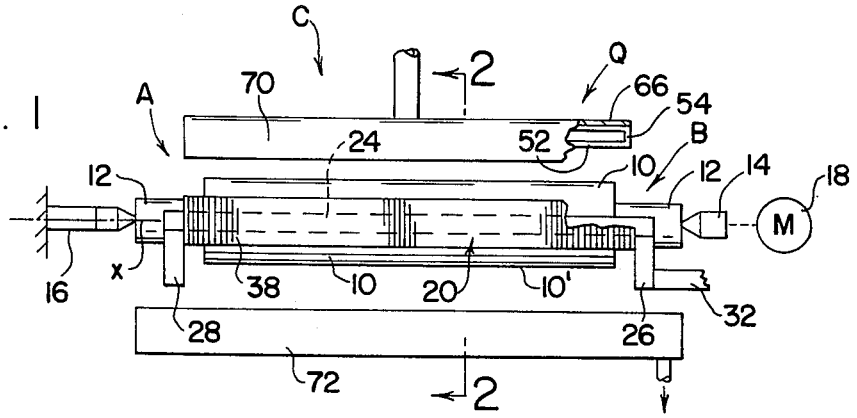
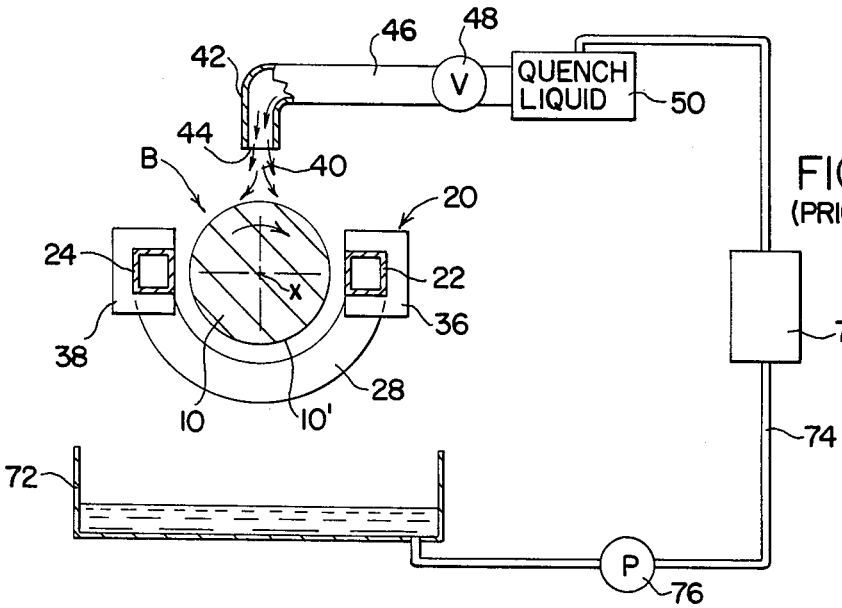
FIG. 2
(PRIOR ART)
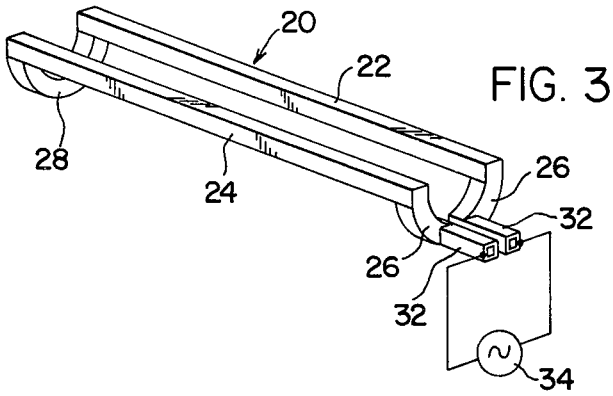
FIG. 3

QUENCHING DEVICE FOR INDUCTIVELY HEATED WORKPIECES

BACKGROUND OF THE INVENTION

The present invention relates primarily to the art of inductive heating and, more particularly, to an apparatus for inductively heating and then quench hardening and tempering a circumferential surface portion of a workpiece.

The invention is particularly applicable to inductively heating and then quench hardening a propeller shaft, and it will be described with particular reference thereto; however, it should be appreciated that the invention has much broader applications and may be used for inductively heating and quench hardening various other workpieces.

In the production of steel propeller shafts such as are used in motor vehicles to transmit power from the transmission output shaft to the differential, it is customary to harden the cylindrical surface portions of the shaft to impart toughness and uniform surface characteristics thereto. One of the most commonly employed methods for hardening these shaft surface portions is by inductively heating them to a temperature (generally around 1750° F.) above the critical range of the particular steel of which the shaft is made, while the shaft is rotated about its central axis, and then rapidly cooling the heated surface portion of the rotating shaft by directing a stream or jet of coolant or quench fluid, such as a water-based quenching oil, from an overhead quench head downwardly onto the top of the heated surface portion of the rotating shaft. This quenching, however, of the heated surface portion of the shaft sets up hardening strains therein and causes surface brittleness which is apt to cause cracking. To relieve these hardening strains and reduce the surface brittleness, the quench hardened surface portion of the rotating shaft is then inductively reheated promptly to a somewhat lower temperature, e.g., from 800° to 1000° F., to temper or "draw back" the hardness of the quench hardened surface portion and increase its toughness.

With the prior quenching arrangements as described above having its quench head located directly above the heated surface portion of the propeller shaft, the drippage of residual quench fluid from the overlying quench head or nozzle end, which normally occurs following the shut-off of the supply of quench fluid to the quench head to terminate the quenching operation, would drop onto and contact the quench-hardened shaft surface portion during the subsequent reheating and tempering thereof. This caused the formation of so-called hard spots or incompletely tempered surface areas in the final quench hardened and tempered circumferential surface portions of the shaft. The resulting treated surface portions of the shaft thus possessed undesirable non-uniform surface characteristics.

SUMMARY OF THE INVENTION

The present invention contemplates a new and improved apparatus for inductively heating and quench hardening and tempering selective circumferential surface portions of a steel workpiece, such as propeller shafts and the like, which overcomes the above referred to problem and others and provides hardened surface portions on the workpieces of substantially uniform surface characteristics throughout with no so-called hard spots or incompletely tempered surface areas therein.

Briefly stated, in accordance with one aspect of the present invention there is provided a quenching device for directing quench fluid onto the top of an inductively heated circumferential surface portion of a steel workpiece rotating about a central axis, and having a quench head or nozzle end spaced horizontally from, i.e., off to one side of said surface portion out of overlying relation thereto, so that any drippage of residual quench fluid from the quench head, upon shut-off of the supply of quench fluid to the quench head to terminate the quenching operation, will drop clear of the quench hardened surface portion of the workpiece and not contact therewith during the ensuing inductive reheating thereof to temper such surface portion.

In accordance with a further aspect of the invention, the quench head located out of overlying relation to the surface portion of the workpiece to be quench hardened is arranged to direct a stream or jet of quench fluid therefrom in a substantially horizontal path transversely of the axis of the rotating workpiece and across and above the surface portion thereof to be quench hardened, and a deflector means is arranged to intersect the horizontal path of, and deflect and guide the quench fluid jet from the quench head downwardly onto the top of the inductively heated surface portion of the rotating workpiece to quench harden the same. The deflector means may be in the form of a plate-shaped member mounted on the quench head and extending therefrom in immediately overlying relation to the path of the quench fluid jet emanating from the quench head, the plate-shaped deflector member projecting over the heated surface portion of the workpiece and being curved downwardly at its projecting end to deflect and guide the quench fluid jet downwardly onto the heated surface portion of the rotating workpiece.

The principal object of the invention is to provide a device for quench hardening an inductively heated circumferential surface portion of a workpiece rotating about its central axis and forming such surface portion with substantially uniform surface characteristics throughout.

Another object of the invention is to provide a device for quench hardening and tempering an inductively heated circumferential surface portion of a workpiece while rotating about its central axis at an inductive heating station to form such surface portion with substantially uniform tempered surface characteristics throughout.

Still another object of the invention is to provide a quenching device for directing a jet of quenching fluid onto the top of an inductively heated circumferential surface portion of a workpiece rotating about its central axis at an inductive heating station without causing the contacting of any drippage of residual quench fluid from the device with such surface portion following shut-off of the supply of quench fluid to the device and during subsequent inductive reheating of the surface portion at the heating station to effect the tempering thereof.

Further objects and advantages of the invention will appear from the following description of a species thereof and from the accompanying drawings.

BRIEF DESCRIPTION OF THE DRAWINGS

In the drawings:

FIG. 1 is a side elevation showing, partly schematically and in section, an inductive heating and quenching apparatus comprising the invention;

FIG. 2 is a cross-sectional view taken along the line 2—2 of FIG. 1 but showing instead a quenching device according to the prior art;

FIG. 3 is a perspective view, partly schematic, of the inductor shown in FIG. 1 for inductively heating a workpiece to be quench hardened;

DESCRIPTION OF THE PREFERRED EMBODIMENT

Figure 4:
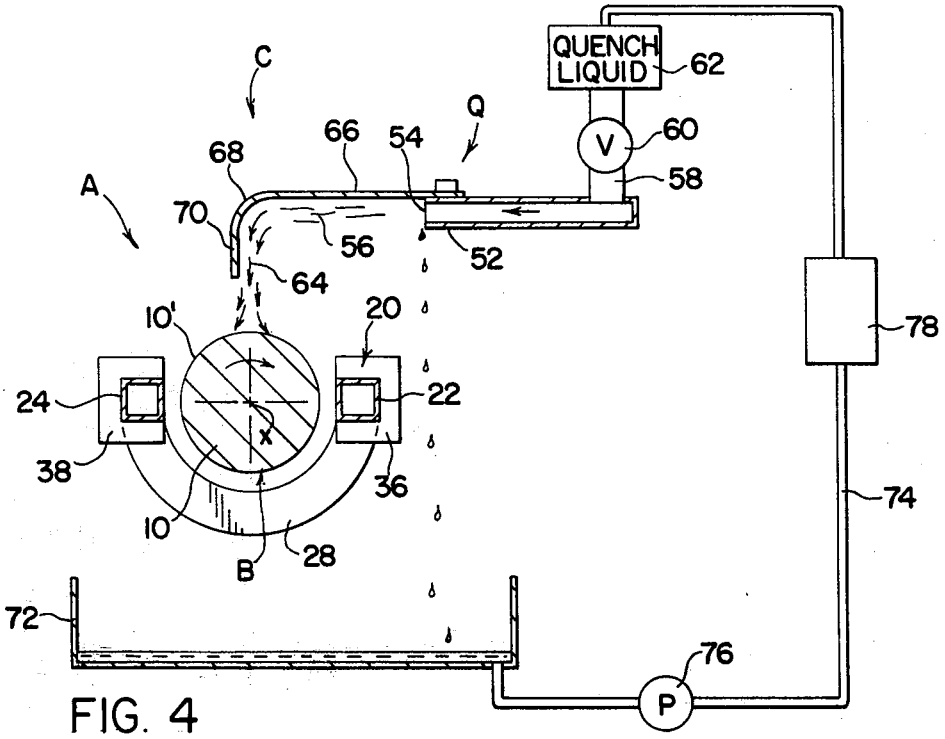
FIG. 4 is a cross-sectional view similar to FIG. 2 but showing the quench device comprising the invention; and, FIG. 5 is a side elevation similar to FIG. 1 but showing only the rotatively mounted workpiece and the quench device therefor.
Figure 5:
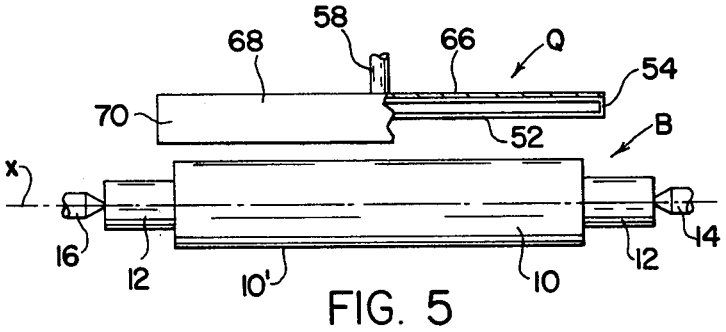

Referring now to the drawings wherein the showings are for the purpose of illustrating the preferred embodiment of the invention only and not for the purpose of limiting same, FIG. 1 shows, partly schematically, an apparatus A for inductively heating and quench hardening a circumferential surface portion of an elongated workpiece such as propeller shaft B having a central axis x. The shaft B is formed of iron or steel and includes a cylindrical body portion 10 concentric with the shaft axis x, and axially extending cylindrical end portions 12 of reduced diameter and likewise concentric with the axis x.

The apparatus A may take a variety of forms; however, in accordance with the preferred embodiment of the invention, two axially aligned opposed support means 14, 16 similar to the dead centers employed on machine lathes, engage the opposite ends of the workpiece or shaft B for rotatably mounting it for rotation about its central axis x at a heating station C. Appropriate means such as an electric motor, schematically illustrated at 18, is used to rotate the workpiece B about its axis x as it is being heated and quenched, as hereinafter described. The device for rotating the workpiece forms no part of the present invention and it may take a variety of forms. In the particular case illustrated, however, the motor driven shaft or support means 14 is suitably rotatively interlocked with the workpiece or shaft B in order to impart its rotational movement thereto when the support means is rotated by the motor.

The apparatus A according to the invention is designed to inductively heat the circumferential outer surface layer 10' of the cylindrical body portion 10 of shaft B, while rotated about its axis x at the heating station C, initially to a temperature above the critical temperature of the particular steel or other material of which the shaft is made, then quench the so heated surface portion 10' of the shaft while positioned at the heating station with a liquid coolant to quench harden the surface portion 10' of the rotating shaft, and finally inductively reheat the surface portion 10' of the rotating shaft, while still positioned at the heating station C, to a temperature somewhat lower than its critical temperature in order to temper the surface portion 10' and impart toughness thereto. In the apparatus A illustrated, the inductive heating of the shaft surface portion 10' at the heating station C is accomplished by an inductor 20 (FIG. 3) located thereat and comprised of a pair of parallel side conductors 22,24, cross-over or end conductors 26,28 interconnecting the two parallel side conductors 22,24 at their opposite ends, and power leads 32 interrupting cross-over conductor 26 and adapted to be connected across the output of a suitable source 34 of high frequency alternating current for energizing the inductor 20. As shown, the inductor 20 is supported in position at the workpiece heating station C with its parallel side conductors 22,24 extending horizontally in the horizontal plane of, and parallel to, the axis x of the shaft B at the heating station C and spaced apart horizontally so as to lie closely alongside the shaft surface portion 10'. In accordance with normal practice, U-shaped iron laminations 36,38 may be provided around the parallel side conductors 22,24 for concentrating the flux within a shaft B at the heating station C. The side conductors 22,24 are of a length at least corresponding to the length of the surface portion 10' of the shaft to be heated. By energizing the inductor 20 and rotating the shaft B, the outer surface layer of the circumferential surface portion 10' of the shaft is inductively heated. The inductor 20 is, of course, suitably supported in place on a support base (not shown).

After the inductive heating of the surface layer of the circumferential surface portion 10' of the shaft B to a temperature above its critical temperature by the inductor 20, the heated surface portion 10' is quench hardened by directing a stream or jet of liquid coolant or quench liquid under pressure downwardly onto the top of the rotating surface portion 10' while the shaft B is still positioned at the heating station C. Heretofore, in conventional prior art arrangements as shown in FIG. 2, this pressurized jet 40 of the quench liquid was directed downwardly onto the surface portion 10' of the shaft to be quench hardened from a quench head or nozzle 42 having its outlet end 44 directly overlying and, as shown, at least substantially coextensive with this surface portion and connected, through a conduit 46 and a shut-off valve 48 therein, to a reservoir supply 50 of the coolant or quench liquid. With such prior arrangements, however, because of the positioning of the quench liquid outlet or nozzle end 44 of the quench device directly over the shaft surface portion 10' to be quench hardened, the residual quench liquid remaining in the quench head 42 and conduit 46 following shut-off of the supply of quench liquid thereto by the closure of valve 48, would drop onto and contact the surface portion 10' of the shaft B at various points along the length thereof during the customary immediately following inductive reheating of the quench hardened surface portion 10' of the rotating shaft by the inductor 20 to temper it. This then caused the formation of so-called "hard spots," or incompletely tempered surface areas, throughout the surface portion 10' of the shaft, thereby resulting in non-uniform surface characteristics therefor.

In accordance with the invention, the apparatus A is provided with a quench device Q (FIGS. 1 and 4) comprising a quench head or nozzle 52 having an outlet end 54 which, as shown, is at least substantially coextensive with the surface portion 10' of the shaft B positioned at the quenching station C and which is arranged to direct therefrom a stream or jet 56 of liquid coolant or quench liquid under pressure, such as a water-based quenching oil. In contrast to previous prior art arrangements, however, the outlet end 54 of the quench head 52 is located, as shown in FIG. 4, in horizontally spaced relation to the shaft B, i.e., is laterally offset completely to one side of and out of overlying relation to the shaft B, when the latter is positioned at the heating station C, so as not to overlie any part of the shaft surface portion 10' to be quench hardened. The quench head 52 is connected through a valved conduit 58, provided with a shut-off valve 60, to a pressurized supply of liquid coolant or quench liquid from a reservoir supply 62 thereof.

In the preferred embodiment according to the invention, the outlet end 54 of the quench head 52 is located at an elevation somewhat higher than the top of the circumferential surface portion 10' of the shaft B to be quench hardened, and it is arranged to direct the jet 56 of coolant or quench liquid therefrom in a substantially horizontal path extending transversely across and above and overlying substantially the entire length of the surface portion 10' of the camshaft. The horizontally directed stream or jet 56 of quench liquid from the quench head 52 is then deflected and guided downwardly as indicated at 64 onto the top of the surface portion 10' of the rotating shaft B by deflector means such as a plate-shaped deflector member 66 extending horizontally in a position directly overlying the horizontal path of the quench fluid jet 56 emanating from the quench head 52 and thus at least coextensive with and projecting over the surface portion 10' of the shaft. To this end, the jet 56 must have sufficient force to follow along the deflector member 66, i.e., not to drop away therefrom. The deflector member 66 may, as shown, be mounted directly on the quench head 52 and project therefrom so as to intersect the path of the quench liquid jet 56.

At its projecting outer end and more or less directly over the center of the shaft B, the deflector member 66 is curved or bent downwardly as indicated at 68, approximately about a bend axis parallel to the shaft axis x, to form a downwardly projecting lip portion 70 extending vertically or slightly declined outwardly, and terminating closely adjacent the top of the surface portion 10' of the shaft and slightly forwardly of the center thereof, so as to deflect and guide the jet 56 of quench liquid downwardly into a downward falling stream or jet 64 directed approximately centrally onto the top of, and throughout substantially the entire length of the heated surface portion 10' of the rotating shaft. The downwardly directed jet 64 of coolant then flows continuously downward and more or less evenly over the sides of the rotating heated surface portion 10' of the shaft to thereby quench and so harden it. In most instances, this quenching operation needs to be continued for only a matter of a few seconds or so in time to lower the temperature of the heated surface layer of the shaft surface portion 10' the required amount (e.g., to a temperature in the range of several hundred degrees F) to effect the desired quench hardening of the surface portion 10'. The quench operation is terminated by the closure of the shut-off valve 60 in the quench liquid supply conduit 58 for the quench head 52. The quench liquid flowing downward off the shaft B during the quenching operation may be collected in an underlying tray 72 and circulated therefrom back to the supply reservoir 62 through a communicating conduit 74 and a circulating pump 76 and a heat exchanger and cooling unit 78 connected in the conduit, as is customary in conventional quenching arrangements.

Immediately following the quenching operation, the quench hardened surface portion 10' of the shaft B, while the shaft is still positioned at the heating station C and rotated about its axis x, is reheated by the energization of the inductor 20 to an elevated but considerably lower temperature than its critical temperature, e.g., to a temperature in the general range of from 800° to 1000° F. for most compositions of propeller shafts commonly in use at present, to effect the tempering or drawing of the surface portion 10' to reduce its brittleness and impart toughness thereto. Because of the laterally offset location of the outlet or nozzle end 54 of the quench head 52 completely to one side of the surface portion 10' of the shaft B so as not to overlie the same, any flow or drippage of residual quench fluid from the quench head 52 following the closure of the shut-off valve 60 to terminate the quenching operation, and during the ensuing reheating of the surface portion 10' of the shaft by the inductor 20 to effect the tempering thereof, is kept from dropping onto and contacting this heated surface portion 10' and instead falls clear and off to one side of the surface portion 10'. In this way, the formation of so-called "hard spots" or incompletely tempered surface areas on the surface portion 10' such as otherwise would be formed therein by the contacting of any such residual quench fluid drippage onto the quench hardened surface portion 10' during its reheating to temper it, is completely avoided by the use of a quench device Q according to the invention. Thus, quench hardened and uniformly tempered surface portions 10' having uniform surface characteristics are formed on the shaft B.

Having thus described my invention, I now claim:

1. A device for directing quench fluid from a supply thereof onto the top of an inductively heated circumferential surface portion of a workpiece rotating about a central axis and axially stationary, said device comprising: supply means including an outlet end offset completely to one side of and out of overlying relation to, and substantially coextensive with, said heated surface portion of said axially stationary rotating workpiece for directing from said outlet end an unconstrained jet of quench fluid under pressure from a position spaced horizontally from said surface portion out of overlying relation thereto, deflector means intercepting and guiding said quench fluid jet downwardly onto the top of and throughout substantially the entire length of the said heated surface portion from above to quench the same, and means for selectively actuating said supply means.

2. A device as specified in claim 1 wherein the said supply means includes a quench head provided with the said outlet end and said deflector means is mounted on said quench head.

3. A device as specified in claim 1 wherein the said deflector means comprises a plate-shaped member projecting at one end over the top of said surface portion and curved downwardly at its said projecting end to deflect and guide the said quench fluid jet downwardly onto the top of said heated surface portion of the workpiece.

4. A device as specified in claim 1 wherein the said supply means is arranged to direct the said quench fluid jet from its said outlet end in a substantially horizontal path extending transversely across and above and overlying substantially the entire length of the said surface portion of the workpiece, and said deflector means extends horizontally in a position directly overlying the said horizontal path of the said quench fluid jet emanating from said quench head and projects over the said surface portion of the workpiece and is curved downwardly at its projecting end to intercept and guide the said quench fluid jet downwardly onto the top of and throughout substantially the entire length of the said heated surface portion of the workpiece.

5. A device as specified in claim 4 wherein the said supply means includes a quench head provided with the said outlet end and said deflector means is mounted on said quench head.

6. A device as specified in claim 5 wherein the said deflector means comprises a plate-shaped member extending horizontally from said quench head.

7. In combination with means for inductively heating a selected surface portion of the length of a workpiece having a central axis while said workpiece is positioned with its said axis horizontal and is axially stationary and rotated about its said axis, a quenching means comprising a quench head substantially coextensive with the said surface portion of the so positioned rotating workpiece and connected through a valved conduit to a supply of quench fluid under pressure, said quench head having an outlet end at an elevation higher than said surface portion and offset completely to one side of and out of overlying relation to said surface portion, said outlet end being arranged to direct a jet of quench fluid therefrom in a substantially horizontal path extending transversely across and above and overlying substantially the entire length of the said surface portion of the workpiece, and deflector means intersecting the path of the said quench fluid jet from said outlet end for deflecting and guiding said jet downwardly and approximately centrally onto and throughout substantially the entire length of the said heated surface portion from above to quench the same, the said offset of said outlet end to one side of and out of overlying relation to the workpiece serving to locate any drippage of residual quench fluid from the outlet end, on closure of said valved fluid supply conduit, entirely to one side of and out of contact with the said heated surface portion of the workpiece.

8. The combination as specified in claim 7 wherein the said deflector means is mounted on said quench head.

9. The combination as specified in claim 7 wherein the said deflector means comprises a plate-shaped member extending horizontally from said quench head in a position directly overlying the said horizontal path of the said quench fluid jet emanating therefrom, on opening of said valved supply conduit, and projecting over the said surface portion of the workpiece and curved downwardly at its projecting end to deflect and guide the said quench fluid jet downwardly onto the top of and throughout substantially the entire length of the said heated surface portion of the workpiece.

10. In a device for inductively heating and quench-hardening a workpiece having a central axis and a surface portion extending therearound of a given axial length, said device comprising a workpiece heating inductor including two parallel conductors extending horizontally and along opposite sides of said surface portion throughout the length thereof when the workpiece is in its heating position and a cross-over conductor joining said parallel conductors at one end, means connected to the other ends of said parallel conductors for energizing said inductor to heat said surface portion; means for supporting said workpiece in its said heating position, with the workpiece axially stationary and its said axis horizontal, for rotation of the workpiece about its said axis while in its said heating position; means for rotating said workpiece about said axis while it is being heated; and, quenching means for directing a jet of quench fluid downwardly onto the top of and throughout substantially the entire length of the said heated surface portion of said workpiece from overhead while in its heating position, the improvement comprising: said quenching means comprising a quench head substantially coextensive with the axial extent of said surface portion of the workpiece when in its said heating position and connected through a valved conduit to a supply of quench fluid under pressure, said quench head having an outlet end at an elevation higher than said surface portion and offset completely to one side of and out of overlying relation to said surface portion, said outlet end being arranged to direct a jet of quench fluid therefrom in a substantially horizontal path extending transversely across and above and throughout substantially the entire length of the said surface portion of the workpiece, and deflector means intersecting the path of the said quench fluid jet from said outlet end for deflecting and guiding said jet downwardly onto the top of and throughout substantially the entire length of the said surface portion from above to quench the same, the offset of said outlet end to one side of and out of overlying relation to the workpiece serving to locate any drippage of residual quench fluid from the outlet end, on closure of the said valved fluid supply conduit, entirely to one side of and out of contact with the said heated surface portion of the workpiece.

11. A device as specified in claim 10 wherein the said deflector means is mounted on said quench head.

12. A device as specified in claim 10 wherein the said deflector means comprises a plate-shaped member extending horizontally from said quench head in a position directly overlying the said horizontal path of the said quench fluid jet emanating therefrom, on opening of said valved supply conduit, and projecting over the said surface portion of the workpiece and curved downwardly at its projecting end to deflect and guide the said quench fluid jet downwardly onto the top of and throughout substantially the entire length of the said heated surface portion of the workpiece.

* * * * *